United States Patent [19]

Roos

[11] 4,240,169

[45] Dec. 23, 1980

[54] PATIENT TRANSFERRING APPARATUS

[76] Inventor: Kjell E. H. Roos, Tuvängsvägen 15, 752 45 Upsala, Sweden

[21] Appl. No.: 6,891

[22] Filed: Jan. 26, 1979

[51] Int. Cl.[3] ..... A47C 3/32; A61G 7/10

[52] U.S. Cl. ..... 5/60; 5/81 R; 5/86; 5/431; 5/445; 297/DIG. 4

[58] Field of Search ..... 5/60, 81 R, 86, 66–69, 5/431, 432, 445; 280/13, DIG. 3, 242 WC; 297/DIG. 4

[56] References Cited

U.S. PATENT DOCUMENTS

| | | | |
|---|---|---|---|
| 3,138,805 | 6/1964 | Piazza | 5/60 |
| 3,912,032 | 10/1975 | Benz et al. | 297/DIG. 4 |
| 4,183,109 | 1/1980 | Howell | 5/86 |

FOREIGN PATENT DOCUMENTS

| | | | |
|---|---|---|---|
| 497662 | 12/1938 | United Kingdom | 5/66 |
| 1259181 | 1/1972 | United Kingdom | 5/68 |
| 1347920 | 2/1974 | United Kingdom | 269/323 |
| 1389344 | 4/1975 | United Kingdom | 5/66 |

*Primary Examiner*—Casmir A. Nunberg

*Attorney, Agent, or Firm*—Roylance, Abrams, Berdo & Farley

[57] ABSTRACT

A bed and wheelchair arrangement is disclosed in which a center portion of the bed includes, or is attachable to, apparatus for forming a chair on wheels. The center section of the bed mattress is hinged so that it can be bent to form a chair seat and back. In one embodiment, a support portion for the center mattress section is hinged to support the mattress in the chair configuration. In another embodiment, the carrier structure swings through the bed structure.

8 Claims, 9 Drawing Figures

PATIENT TRANSFERRING APPARATUS

This invention relates to an apparatus for transferring a person, such as a bed-ridden patient, into a wheelchair, and particularly for facilitating such transfer without significant manual assistance.

BACKGROUND OF THE INVENTION

Arrangements for transferring a bed-ridden patient from a bed into a wheelchair are found relatively rarely and mostly exist in hospitals and long-term care establishments. These arrangements normally comprise a movable lifting device by which a patient can be lifted by means of a strap or lowered into a conventional type wheelchair. This procedures is a complicated one and is additionally risky and uncomfortable for the patient. When no such special devices are available, the bed-ridden patient is lifted from his bed manually, as by two nursing personnel, for example, and placed into the wheelchair, this requiring strenuous work by the ward personnel.

BRIEF DESCRIPTION OF THE INVENTION

An object of the present invention is to provide an apparatus for facilitating the transfer of a bed-ridden person to a wheelchair, which apparatus is extremely simple to handle and which, in certain cases, permits a bed-ridden person whose movements are greatly restricted to move himself from the bed into a wheelchair with practically no risk of injury.

Briefly described, the invention includes an apparatus for facilitating the transfer of a person from a bed to a wheelchair comprising the combination of a bed having a frame, a mattress having head and foot portions and a center portion, and carrying means for supporting the center portion, at least the center portion being bendable along a line substantially parallel with the longitudinal centerline of the bed so that a section thereof on one side of the line can be pivoted upwardly into the position of a chair-like back support for the person while the other section thereof serves as a seat, and wheeled carriage means operatively associated with said carrying means and the center portion for supporting and laterally extracting the center portion and carrying means, as a unit, from the remainder of the bed to serve as a wheelchair.

Thus, in principle, the patient need only sit up in the bed, in appropriate cases with the aid of a raisable and lowerable head end of the bed, and swing up that half of the unit which is to serve as a back support. The patient then swings his legs over the edge of the bed and turns his body so that his back rests against the back support section of the center portion. The wheeled undercarriage can then be connected with the removable unit and the resultant wheelchair can be moved away from the bed.

According to one embodiment of the invention, the carrier means supporting the center portion is provided with a pivot assembly which can be locked in the raised position of the upwardly pivotable portion of the unit. Further, the carrier means supporting the center section is suitably provided on both sides of the center portion with tubular members into which two arms of the carriage can be inserted. According to a further embodiment of the invention, the carrier means supporting the center portion is fixedly connected to the wheeled carriage, the wheels of which can be raised and lowered.

Suitably, the carriage is provided with arm supports capable of being connected to the collapsible part of the carrier means. When the wheeled carriage is fixedly connected to the removable assembly, the patient himself can move to the wheelchair and the wheels of the carriage can be constructed so as to be readily lowered onto the floor, thereby raising the carriage slightly to permit it to be readily disconnected from the bed. Yet another embodiment involves carrier means comprising a pivotable section which swings upwardly through the bed structure to bend and support the center mattress section in a chair-like position.

In order that the manner in which the foregoing and other objects are attained in accordance with the invention can be understood in detail, particularly advantageous embodiments thereof will be described with reference to the accompanying drawings, which form a part of this specification and wherein.

Figure 1:
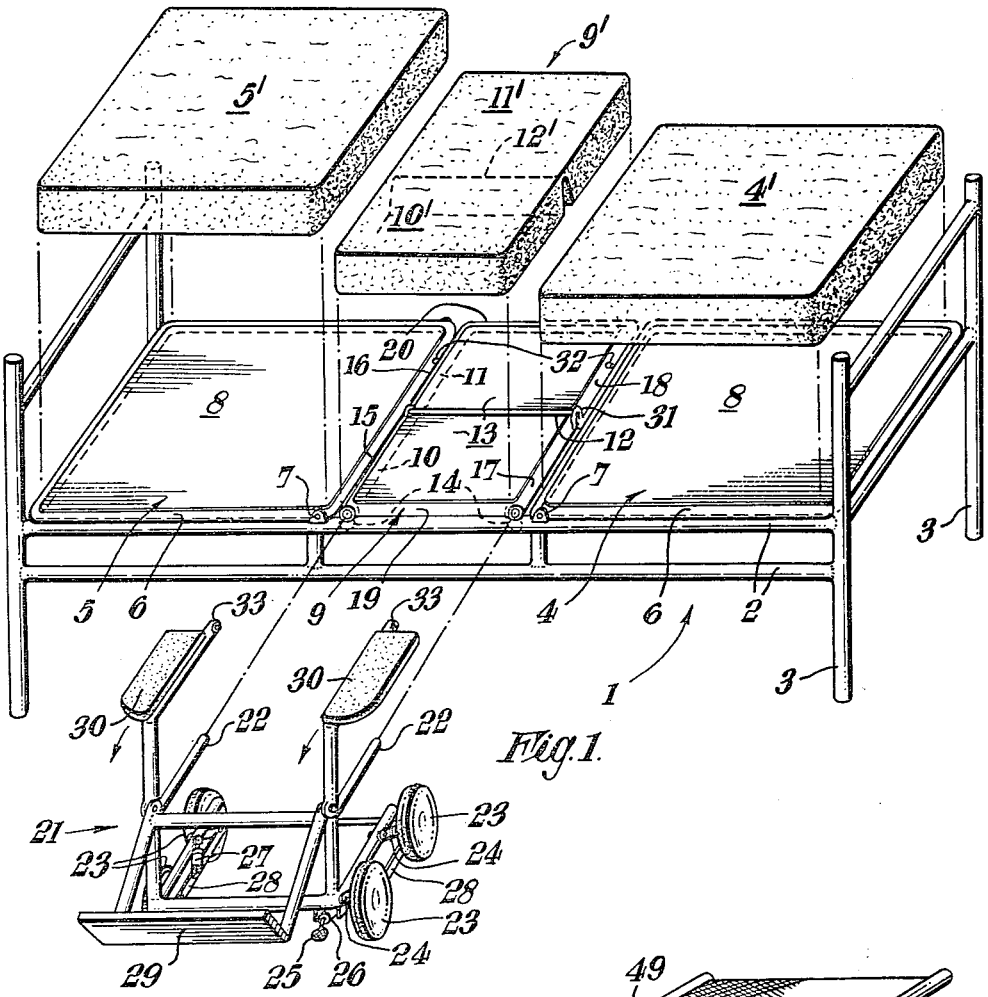
FIG. 1 is an exploded perspective view of an apparatus in accordance with the invention.

FIGS. 1–4 show a bed indicated generally at 1 including a conventional tubular frame 2 having two tubes extending along each longitudinal side of the bed, these tubes being attached to and supported by head and foot structures including steel tubes 3. Arranged at the head end of the bed is a raisable and lowerable bed portion 5 and at the foot end of the bed there is a further raisable and lowerable portion 4. Each of portions 4 and 5 includes a rectangular steel-tube frame 6 pivotably mounted on journals 7 and carrying a planar plate 8. Arranged between the parts 4 and 5 is a rectangular steel-tube intermediate frame portion 9. The frame 9 comprises two U-shaped members 10 and 11, the ends of which closest to the longitudinal centerline of the bed are pivotably connected to one another through a shaft 12 which extends parallel with the longitudinal centerline of the bed. Each of the frame members 10 and 11 carries a planar plate 13 and is supported by two transversely extending beams 14 which extend between the upper ones of the longitudinally extending side tubes of the frame 2 directly beneath the transverse tube portions 15 and 16 and portions 17 and 18, respectively, of the center frame 9, those tubular portions being securely interconnected by means of two longitudinally extending parts 19 and 20. The parts 15 and 16 and the parts 17 and 18 are pivotably interconnected through shaft 12 so that the section 9 is thus movable in the transverse direction of the bed guided by the transversely extending tubular parts of portions 4 and 5 which are pivotally mounted in the journals 7.

Plates 8 and 13 thus form a base on the bed, the base being divided into three distinct head, foot and center portions which support mattress or pad portions 4', 5' and 9' lying, respectively, over portions 4, 5 and 9 of the bed structure. The center mattress portion 9' is made to be bendable along a line 12' which extends substantially parallel with the longitudinal centerline of the bed. The bendable characteristic is provided by forming a slot extending upwardly from the undersurface partially through the mattress such that the two portions 10' and 11' are connected together only along the upper surface portion of the mattress portion 9'. The line 12' is displaced toward member 19 from shaft 12 by a lateral distance substantially equal to the thickness of the mattress.

Figure 4:
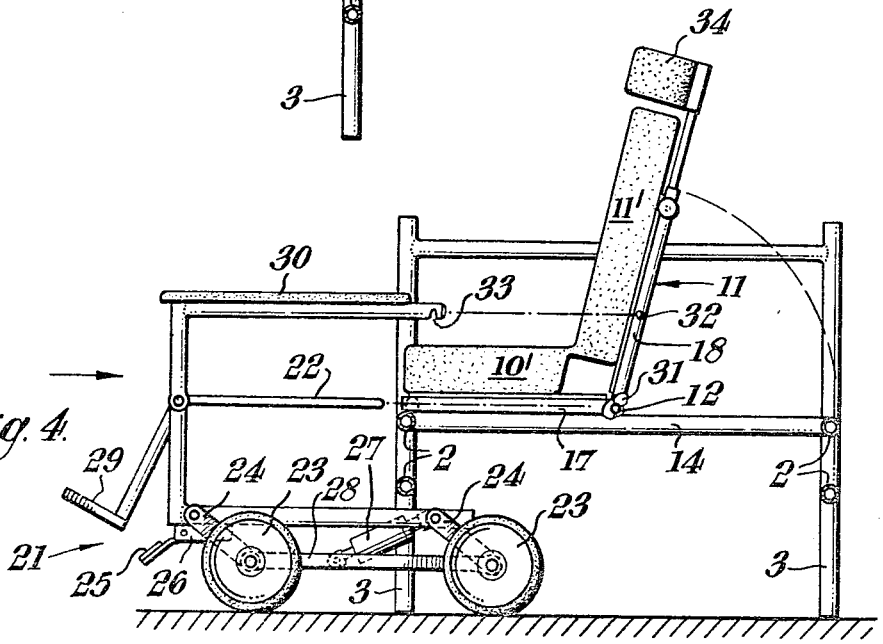
FIG. 4 is an end elevation, in partial section, of a bed incorporating apparatus in accordance with the invention and showing the manner in which the carrying means is coupled to a wheeled carriage.

Operatively associated with the bed structure thus described is a wheelchair carriage indicated generally at 21 arranged to be coupled to the center frame 9 of the illustrated bed in a simple fashion. FIGS. 1 and 4 illustrate an embodiment in which the carriage 21 is provided with two fixed, horizontal lifting arms 22 which are arranged in such a way that they can be inserted into the tubes 15 and 17 of portion 10 of the rectangular center frame 9, the ends of the tubes being open for this purpose. Carriage 21 is also provided with four wheels which are mounted on resilient pivot arms 24. By means of a pedal 25 and an hydraulic pump 26 operated by the pedal and connected with an hydraulic piston and cylinder assembly 27, the angular positions of the pivot arms 24 can be changed. It will be observed that the wheel mounting structure includes a parallelogram arrangement formed by the lower portion of the wheeled carriage, links 24 and links 28 such that the carriage 21 can be moved to a vertical position in which the lifting arms 22 can be inserted in tubes 15 and 17, and to a further raised position in which the portion 10 of the rectangular frame 9 is lifted slightly from the frame 2 of the bed, and away from the associated support beams 14. Carriage 21 is also provided with a foot support 29 and two pivotable arm supports 30 which have locking mechanisms 33 which can be connected to pegs 32 on opposite sides of portion 11 after portion 11 has been pivoted into a back support position, as will be described. If desired, a neck support 34 (FIG. 4) can also be mounted on portion 11.

The apparatus thus far described is usable in the following manner. The patient is initially presumed to be lying on the bed with his head toward that end of the bed having mattress portion 4'. Portion 4 is then elevated into a partial sitting position by pivoting it about journals 7, either manually or by the aid of powered devices, either electric or hydraulic, commonly found in hospital beds. At this point, the patient is in a sitting position with his legs remaining on mattress portion 5', and with his body resting primarily on portion 10' of the center mattress section. The carriage 21 is then moved into position and the lifting arms 22 are inserted into the tubular members 15 and 17 of frame portion 10. Frame portion 11 is then pivoted into a nearly vertical position and locked in that position by means such as a hinge-locking device 31 shown in FIG. 3. The legs of the patient are then swung over the side of the bed and his feet are placed on the foot support 29, the patient's back being supported by mattress portion 11 which now is in the position of a chair-like back support. The arm supports 30 can then be swung into a position immediately above tubular portions 15 and 17 and locked securely to the locking pegs 32 of tubular members 16 and 18.

The frame part 9 with the mattress section 9' now forms, together with carriage 21, a comfortable wheelchair to which the patient who is previously lying in bed has now been transferred in a simple and uncomplicated manner. The main portion of the weight of the patient is still resting on support beams 14 of the bed 1 and, in order to release the chair from the bed, the pedal 25 must be depressed so that wheels 23 are forced against the floor, thereby raising carriage 21 a small distance from support beams 14. The wheelchair can then be rolled away from the bed in a direction perpendicular to the longitudinal centerline of the bed.

Figure 5:
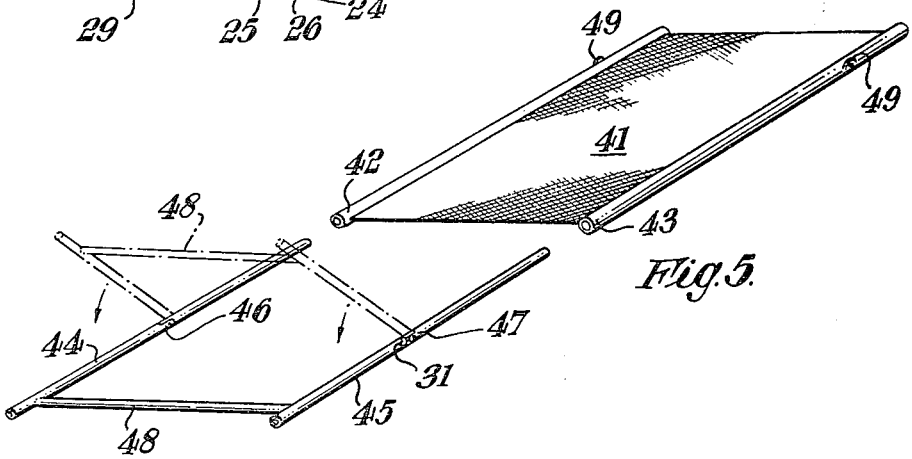
FIG. 5 is an exploded perspective view of a simplified embodiment of a carrying means usable in the invention.
Figure 2:
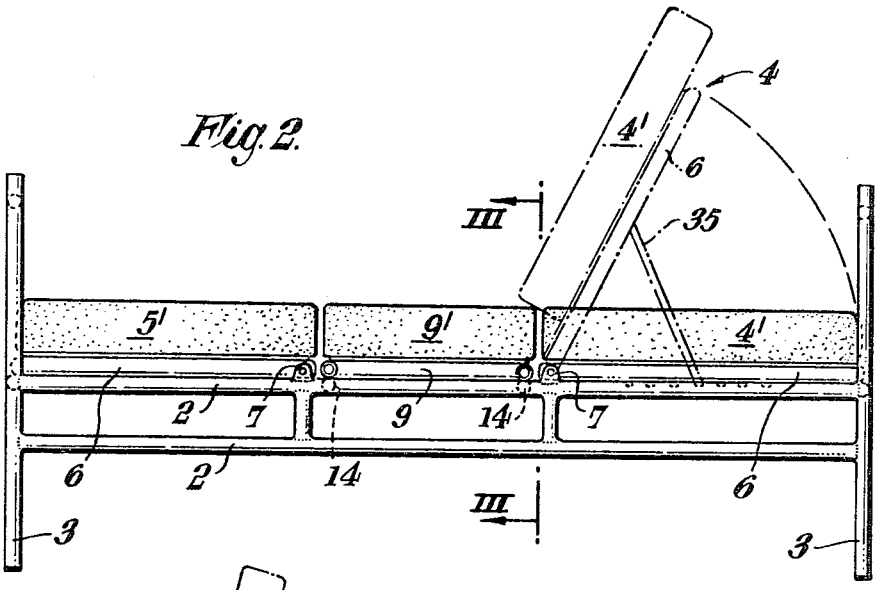
FIG. 2 is a side elevation of a bed incorporating an apparatus in accordance with the invention.
Figure 3:
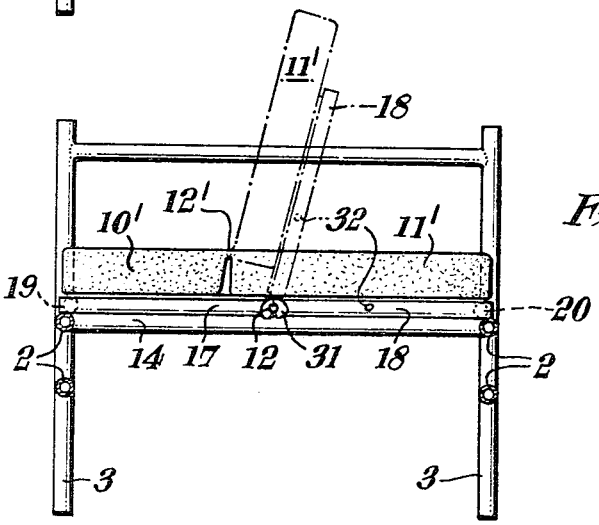
FIG. 3 is an end elevation, in section, along line III—III of FIG. 2.

In a simplified embodiment, which can be used in combination with conventional beds having soft mattresses with spring bases, the center portion 9 can comprise a strong fabric 41 having two longitudinally extending tubular edge passages 42 and 43 which extend transversely across the bed, as illustrated in FIG. 5. The lifting arms 22 of the carriage 21 are intended to be inserted into passages 42 and 43. In this embodiment, the lengths of the lifting arms 22 must be substantially equal in length to passages 42 and 43, and the lifting arms should be provided with lockable linkages, not shown, corresponding to shaft 12 and latching mechanism 31. This construction requires a relatively large amount of space when inserting the lifting arms into passages 42 and 43. The lifting arms may therefore be divided into two portions and comprise a removable portion which can be inserted into passages 42 and 43 at the opposite ends of passages 42 and 43 than the ends from which the members connected to carriage 21 are inserted, the members then being arranged to be coupled together at the hinge points. A simpler arrangement of a similar type is shown in FIG. 5 wherein two carrier arms 44 and 45, the lengths of which correspond to the lengths of passages 42 and 43, are each capable of being pivoted about hinge points 46 and 47, each being provided with a latch 31. The supporting arms 44 and 45 are interconnected by a bracing bar 48 extending between the ends of the arms 44 and 45. Portions 44–48 are a separate unit, the arms 44 and 45 when pivoted (as illustrated in phantom lines) can be inserted partially into the first half of passages 42 and 43 and, after straightening the arms 44 and 45, can be inserted fully into the passages. The ends of the arms 44 and 45 are open and the lifting arms 22 of carriage 21 can be inserted into those open ends as previously described. In this embodiment, the locking pegs 32 of the embodiment shown in FIGS. 1–4 take the form of bosses 49, or some other suitable attachment device arranged in passages 42 and 43 formed by the fabric.

As an alternative to providing the carriage 21 with means for raising and lowering the lifting arms 22 or the wheel supporting devices, it is possible to arrange the apparatus so that the carriage is fixed in elevation and the base of the bed itself can be raised or lowered.

Figure 6:
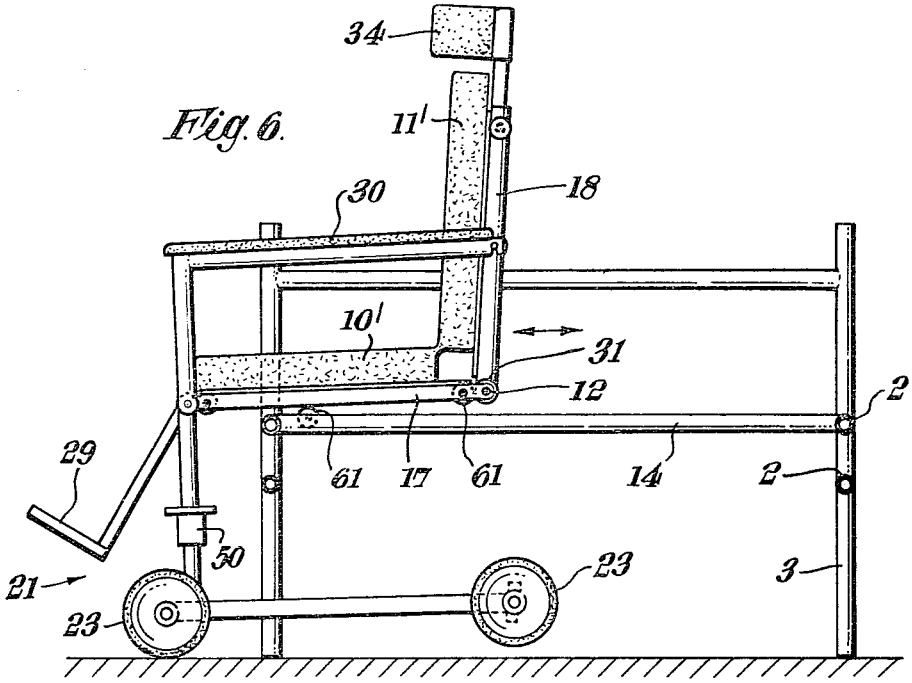
FIG. 6 is an end elevation of a further embodiment in accordance with the invention showing the manner in which the wheelchair can be extracted from the remainder of the bed.

It is also possible to provide small pulleys 61 (FIG. 6) on the beams 14 of the bed and/or on the carriage 21, the required change in height being achieved by tipping the carriage 21 slightly while, at the same time, moving the carriage inwardly toward the bed or away from the bed by means of the pulley 61. A threaded coupling 50 serves as a height adjusting device.

Figure 7:
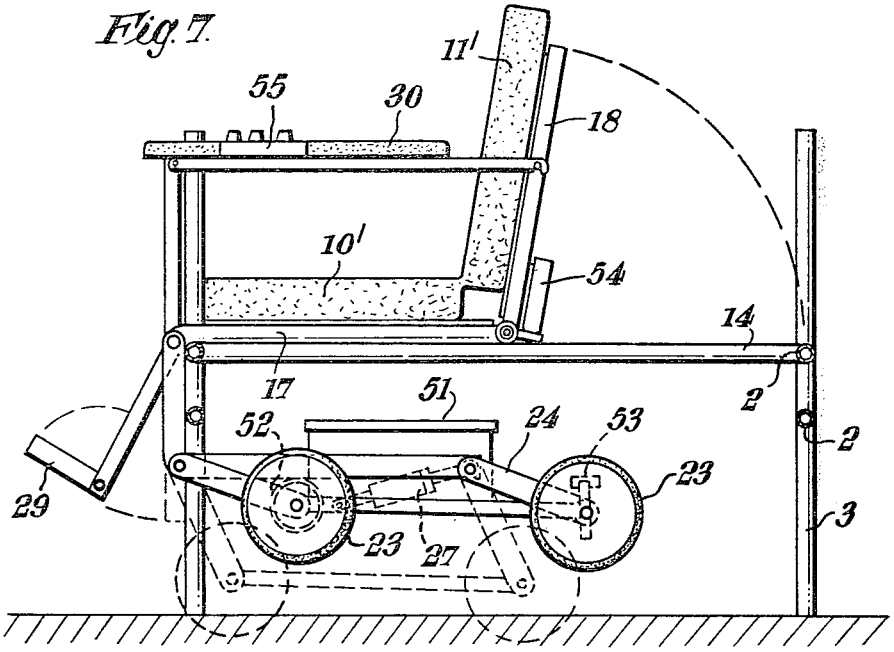
FIG. 7 is an end elevation of a bed structure in accordance with the invention showing an embodiment in which the wheeled carriage means includes raisable and lowerable wheels.

FIG. 7 illustrates a particularly preferred embodiment of the carriage 21 which is fixedly attached to the carrier means formed by center portion 9. The portions 9 and 21 thus form a removable part of the bed itself, the purpose of this arrangement being to enable a patient, who finds it very difficult to move, to seat himself in the wheelchair and move away from the bed and back again. Because with this embodiment it is unnecessary to couple the carriage to the center section of the bed (the carrying means), the center section 9 can simply be lifted slightly above the bed solely by means of the hydraulic cylinder 27 which, in this embodiment, is powered from a conventional pressure source in the form of an electrically driven pump, not illustrated. The electric motor of the pump can be powered by a storage battery 51 which can also be used to energize one or more electric motors 52 for propelling and guiding the wheelchair. A worm-gear motor 54 can also be arranged to be driven by the battery for raising and lowering frame portion 11. Operation of the arm supports and their connection with the locking peg 32 of frame portion 11 can also be accomplished in a comparatively simple manner by means of hydraulic or electric devices. The only muscles which the patient need use in such an extreme case are those required to operate a keyboard 55 or similar control device, and for swinging his legs and rotating his body, the trunk of the patient being constantly supported by the two raised portions 4 and 11. A wheelchair which is operated by means of a keyboard 55 mounted on the arm support 30 of the wheelchair is previously known, the drive and guidance for the chair also being powered by an electric battery. Such a wheelchair can be readily modified to be usable as illustrated in FIG. 7. In this case, the head end 4 of the bed should also be raisable and lowerable by means of a powered electric or hydraulic device, as is conventional with hospital beds.

The invention also contemplates modifications to permit the chair to be rolled over a toilet basin in which case the seat 10' and associated plate 13 would be temporarily removed.

Figure 8:
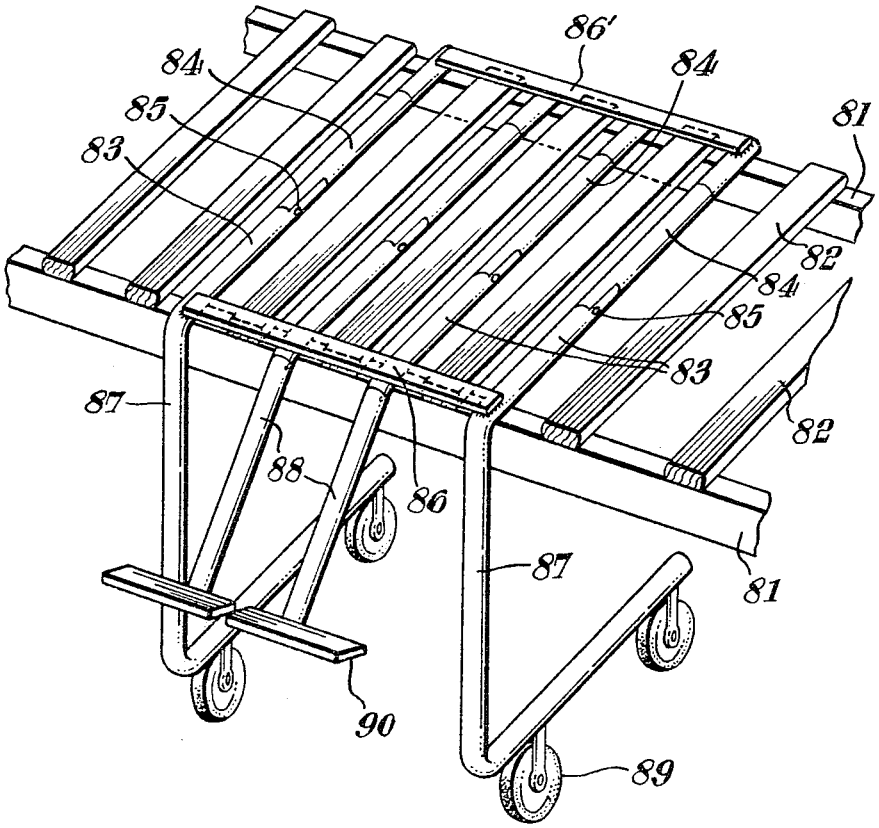
FIG. 8 is a partial perspective view of a further embodiment of the invention showing a bed having a slatted bottom and a wheelchair arrangement having a frame of a simpler kind.

A further embodiment of the apparatus is illustrated in FIG. 8 wherein the general bed structure includes longitudinally extending members 81 and a plurality of transversely extending slats 82. The wheelchair section of the bed in this embodiment has the form of a structure which can readily be married with the general structure of the bed, but which, nevertheless, forms a separate part thereof. Thus, the wheelchair section of the illustrated bed comprises a plurality of steel tubes 83 and 84 which extend transversely with respect to the longitudinal axis of the bed, tubes 83 being pivotably connected by hinge structures 85 to each other such that the tubes 84 can be elevated to an angle which is approximately orthogonal with tubes 83. The tubes 83 are joined near one end to a bar 86 and tubes 84 are joined to a bar 86' which are relatively flat so as to lie almost in the plane of the upper surface of transversely extending members 82. As will be seen in FIG. 8, each of the tube assemblies 83 and 84 is intended to lie in a space between adjacent ones of slats 82 so as to present a substantially planar surface for a mattress section placed on the bed. The tubes 83 are conveniently bent or curved at one end thereof to provide sections 87 and 88 for attaching a foot support 90 and wheels 89, as illustrated. The hinge portions 85 are suitably positioned relative to the respective tube sections 83 and 84 such that the back support comprising bar 86' and tubes 84 is so balanced that it can be raised merely by shifting the weight of the person resting on the tubes.

Figure 9:
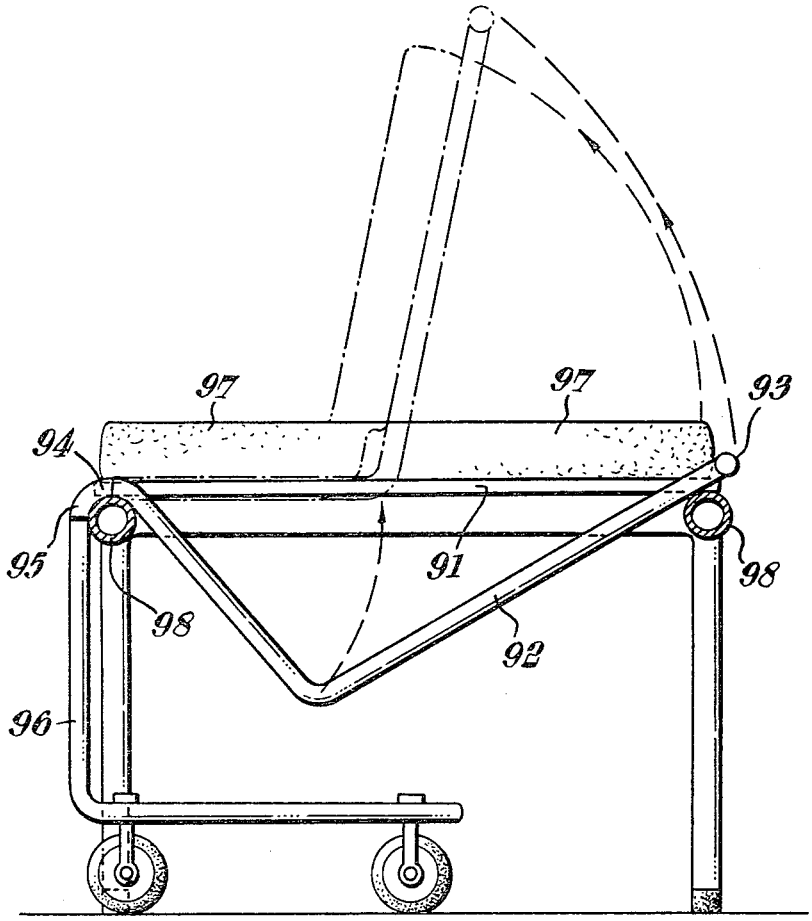
FIG. 9 is an end elevation, in partial section, of a steel-tube bed having a modified wheelchair in accordance with the invention.

FIG. 9 illustrates a particularly preferred embodiment which is of a simpler type but which affords an advantage not available in the previously described embodiments. In the embodiment of FIG. 9, the total length of the seat structure and the back support of the wheelchair frame is substantially greater than the width of the bed. The bed is of a type similar to that shown in FIG. 8, one which includes transverse slats identified in FIG. 9 as 91. The seat structure and back support comprises four steel tubes 92 each of which is bent to form a fixed angle between the portions of the tubes. The upper end of the back portion terminates in a tube 93 which interconnects the ends of tubes 92 and extends longitudinally with respect to the bed, the other end of the tubes 92 being interconnected by a bar 94. Each tube extends downwardly below the horizontal plane containing the slats. The outer ones of tubes 92 extend in a smooth curve into tubular legs 96 through a lockable pivot 95 and, in a manner similar to that shown in FIG. 8, the inner ones of the tubes can be extended to form a foot support, not illustrated in FIG. 9, which can be pivotably connected to bar 94. A hinged or bendable mattress section 97 rests on slats 91 and, when the seat and back support 92 and 93 are swung upwardly into the position illustrated in phantom lines, the back portion of the mattress is also elevated to a raised position. It is also possible to provide a main cushion on the relatively long back support, if so desired. The upper portion of the back support with transverse tubes 93 can also be telescopically extendable from tubes 92.

Neither of the embodiments of FIGS. 8 and 9 need be constructed so that the entire chair structure need be raised or lowered since, particularly in the case of the embodiment of FIG. 8, the seat portion and the back supports 92 can be so constructed, and the hinges between those portions so positioned, that the back portion will automatically raise when the weight of a person resting thereagainst moves his weight, i.e., the hinge is located somewhat above the longitudinally extending frame portions 98 of the bed.

It is also possible to lock the wheelchair, or at least the center portion 9 thereof to the frame of the bed by means of collapsible locking pegs, thereby rendering it unnecessary to make the wheelchair unit raisable and lowerable, this being particularly relevant to the embodiments of FIGS. 1–7.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for facilitating the transfer of a person from a bed to a wheelchair comprising the combination of a bed having an integral frame extending the entire length of said bed and having head, foot and center sections, a mattress having head and foot portions supported by said head and foot sections of said frame, respectively, and a center portion, and carrying means for supporting said center portion removably supported on said center section of said frame;

at least said center portion being bendable along a line substantially parallel with the longitudinal centerline of the bed so that a section thereof on one side of the line can be pivoted upwardly into the position of a chair-like back support for the person while the other section thereof serves as a seat; and wheeled carriage means operatively associated with said carrying means and said center portion for supporting and laterally extracting said center portion and carrying means as a unit from the remainder of the bed to serve as a wheelchair.

2. An apparatus according to claim 1 wherein said carrying means includes lockable hinge means having a pivot axis along said line for locking the upwardly pivoted section thereof in its chain-like back support position.

3. An apparatus according to claim 2 wherein said carrying means includes first and second substantially parallel tubular members extending transversely of said bed adjacent the longitudinally spaced edges of said center portion, and said carriage means includes two arms insertable into said tubular members.

4. An apparatus according to claim 2 wherein said carriage means is fixedly attached to said carrying means and includes means for raising and lowering the wheels thereof.

5. An apparatus according to claim 1 wherein said carrying means includes first and second substantially parallel tubular members extending transversely of said bed adjacent the longitudinally spaced edges of said center portion, and said carriage means includes two arms insertable into said tubular members.

6. An apparatus according to claim 5 and further comprising means connectable between said arms and the upwardly pivotable section of said carrying means for maintaining said section in said chair-like back support position.

7. An apparatus according to claim 1 wherein said carriage means is fixedly attached to said carrying means and includes means for raising and lowering the wheels thereof.

8. An apparatus according to claim 1, wherein said carriage means includes coupling means for detachably securing said carriage means to said carrying means.

* * * * *